United States Patent [19]

Gant et al.

[11] 4,062,336

[45] Dec. 13, 1977

[54] FUEL CONTROL VALVE

[75] Inventors: Gary L. Gant, Columbus; Michael D. Breeden, Columbus; James A. Sting, Columbus; Edward D. Smith, Greensburg, all of Ind.

[73] Assignee: Cummins Engine Company, Inc., Columbus, Ind.

[21] Appl. No.: 578,927

[22] Filed: May 19, 1975

[51] Int. Cl.[2] ..... F02M 39/00

[52] U.S. Cl. ..... 123/139 AF; 137/469

[58] Field of Search ..... 123/140 FG, 139 AA, 123/139 AF, 140 A; 137/115, 469

[56] References Cited

U.S. PATENT DOCUMENTS

| | | | |
|---|---|---|---|
| 2,162,898 | 6/1939 | Rotter | 137/469 |
| 2,470,382 | 5/1949 | Vanni | 123/139 AF |
| 2,880,675 | 4/1959 | Bessiere | 137/115 |
| 2,918,912 | 12/1959 | Reggio | 123/139 AF |
| 2,989,043 | 6/1961 | Reggio | 123/139 AF |
| 3,006,326 | 10/1961 | Barfod | 123/139 AF |
| 3,195,556 | 7/1965 | Norstrud et al. | 137/115 |
| 3,199,532 | 8/1965 | Trick | 137/469 |
| 3,620,647 | 11/1971 | Hofer et al. | 123/140 FG |
| 3,638,629 | 2/1972 | Moon | 123/139 AF |

FOREIGN PATENT DOCUMENTS

| | | | |
|---|---|---|---|
| 468,297 | 12/1951 | Italy | 123/139 AF |

*Primary Examiner*—Ronald H. Lazarus
*Assistant Examiner*—David D. Reynolds
*Attorney, Agent, or Firm*—Gary M. Gron; Robert T. Ruff

[57] ABSTRACT

The disclosure illustrates an anti-tampering fuel control valve for a fuel system providing fuel at a regulated pressure to a series of unit injectors on a diesel engine. The injectors are cam actuated to inject fuel quantities related to the pressure of the fuel supplied to them. The control valve bypasses fuel from the output of the fuel system to a low pressure region when the pressure exceeds a first given level because of fuel system tampering. Orifices in the bypass flow path cause the fuel pressure to follow a schedule generally similar to the normal system pressure schedule but at lower levels. Bypass flow is continued until the fuel system pressure drops to a lower pressure than the pressure at which bypass flow begins.

7 Claims, 3 Drawing Figures

FUEL CONTROL VALVE

The present invention relates to fuel systems for internal combustion engines and more particularly to control valves for such systems.

The unique operating characteristics of the diesel engine require injection of a metered quantity of fuel into the combustion chamber or pre chamber of the engine at or near the point where the pistons reach their top dead center on their compression stroke. There are many types of fuel systems used to accomplish these results. One type of system utilizes unit injectors each having a plunger which is actuated by a cam to inject a given quantity of fuel into the combustion chamber. The quantity of fuel is determined by the pressure of fuel at an orifice leading to the plunger chamber and the time the orifice is open to permit flow. Excess fuel that is not used by the injector is carried through a return line to a low pressure section of the fuel system such as the fuel tank. The pressure for operation of the injector is provided by a fuel control which provides a scheduled pressure output as a function of operator demand and engine RPM.

In systems of this type, some vehicle drivers restrict the drain line to the fuel tank in an effort to increase the available pressure to the injectors and thus increase the engine's power output. The use of restrictions of this type have an adverse affect on fuel economy and long term durability of an engine.

In the past many types of devices have been proposed for preventing fuel system tampering of this type, examples of this type may be found in U.S. Pat. No. 3,741,182, however, with systems of this type the valves are either too complex or easily interfered with. Furthermore, they simply limit the maximum fuel system pressure which occurs at or near maximum engine RPM. Restrictions in the drain line cause an increased pressure throughout the engine RPM range and a valve of this type does nothing to prevent overfueling during intermediate RPM's.

The above problems are solved in accordance with the broader aspects of the invention by a pressure responsive control valve for a fuel system supplying fuel at a variable pressure to an internal combustion engine. The valve comprises a chamber having an inlet extending to the fuel system and a low pressure outlet. A valve element is displaceable in the chamber from a first position in which it prevents flow to a second position in which it permits bypass flow. Fuel pressure urges the valve element towards the second position and a means yieldably urges the valve element towards the first position. The effective area on the valve element exposed to the fuel system pressure is varied from a first area when it is in the first position to a second and larger area when it is in the second position. When the fuel system pressure exceeds a given level the valve bypasses flow to reduce pressure and will not terminate bypass flow until the fuel system pressure has dropped to a second level below the first level.

The present invention will be apparent from a reading of the following description of the disclosure shown in the accompanying drawings and the novelty thereof pointed out in the appended claims. In the drawings:

FIG. 1 is a longitudinal section view of a flow control valve embodying the present invention along with a schematic showing of the fuel system it is used with;

Figure 1:
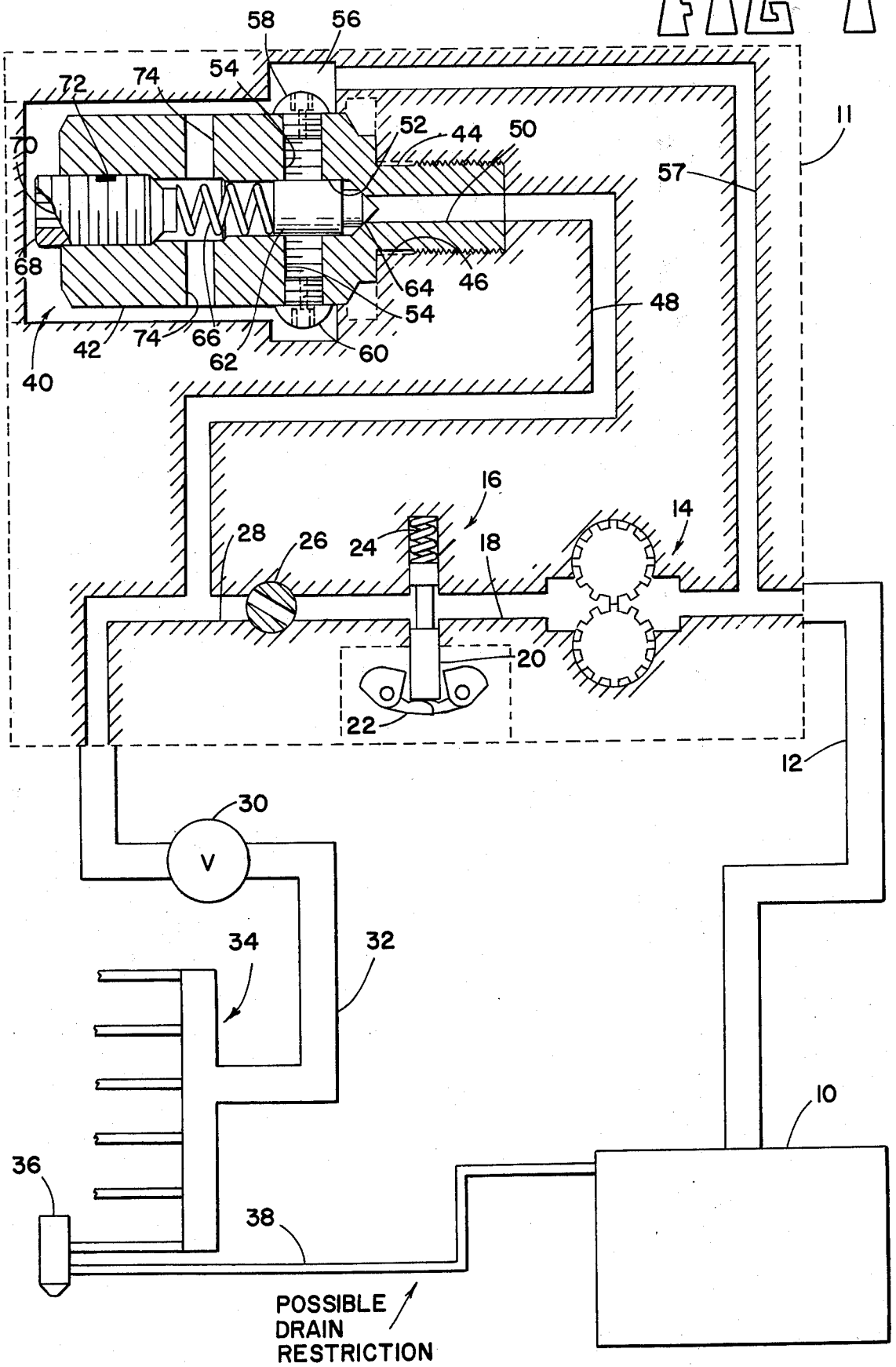

Referring to FIG. 1. there is shown in fuel tank 10 containing a supply of fuel and having a feed line 12 extending to a positive displacement engine driven pump in a fuel control system housing 11. The output of pump 14 passes through a governor assembly 16 via passage 18. Governor assembly 16 has a flow control valve 20 interposed in passage 18 to regulate pressure output of pump 14 in accordance with an engine RPM signal as supplied by a pair of engine driven flyweights acting against a spring 24. Additional pressure regulating functions are provided to regulate the pressure output of the fuel pump 14 but these are not shown for the sake of simplicity. The regulated pressure output of the governor assembly passes through passage 28 to a variable area restriction throttle valve 26 which is operated by operator demand. The output of this valve continues through passage 28 to a shutdown valve 30 on housing 11 that is only open when the engine is to be operated.

A line 32 extends from shutdown valve 30 to a manifold 34 connected to a plurality of injectors 36, only one of which is shown. As stated above, injectors 36 are of the unit type having a cam actuated plunger to inject fuel into the engine combustion chamber. The details of these injectors are not disclosed. However, U.S. Pat. No. 3,351,288 in the name of Julius Perr provides a detailed description of this type injector. The quantity of fuel injected into the cylinder is related to the pressure in fuel manifold 34. This pressure determines the quantity of flow passing through an orifice into a plunger chamber of each injector. Excess fuel not used in the plunger chamber passes from the injectors through a return line 38 to a low pressure section of the fuel system such as the fuel tank 10.

As stated above, some vehicle drivers will place a restriction somewhere in the return line 38. This restriction increases the pressure in the return line section of the injectors 36 and causes the pressure output of pump 14 to substantially increase since it is working against a substantial restriction. The net effect of this is that the pressure output and thus horsepower of the engine is increased over substantially the entire RPM range of the engine.

In order to eliminate this adverse situation a anti-tampering flow control valve generally indicated at 40 is installed within the fuel system housing 11. The flow control valve 40 comprises a housing 42 having a boss 44 threaded into a bore 46 in housing 11. An internal passage 48 in housing 11 extends to boss 44 from passage 28. An inlet port 50 connects with passage 48 and leads to a cylindrical chamber 52 within housing 42. A pair of discharge ports 54 extend from chamber 52 to a chamber 56 within housing 11 which is connected to the inlet of pump 14 by passage 57. Orifices 58 and 60 having predetermined flow areas are threaded into the outlets of ports 54.

A cylindrical valve plunger 62 is displaceable within chamber 52. Plunger 62 has a conical tip 64 formed from a suitable elastomeric material, such as viton, available from Vernay Laboratories, Inc., Yellow Springs, Ohio. The plunger 62 is urged by a spring 66 towards a first position in which tip 64 blocks inlet port 50. A plug 68 is threaded into chamber 52 at the end opposite inlet port 50 and forms one end of chamber 52. A suitable recess 70 on plug 68 receives a tool permitting it to be rotated and thus vary the position of one end of spring 66. An elastomeric pad 72 positioned in the threaded section of plug 68 insures that a given adjusted position will be maintained. Drain ports 74 extend from chamber 52 adjacent plug 70 to low pressure chamber 56.

The valve 40 is adjusted so that the fuel pressure of the system acting on plunger 62 across the area defined by inlet port 50 will displace it towards its second position when the fuel system pressure exceeds the maximum normal scheduled pressure of the fuel system. Once the plunger 62 is unseated the effective area over which the fuel pressure acts is increased to a full diameter of the plunger 62, or in other words, the area of the chamber 52 in a plane taken at a right angle to the direction of travel for plunger 62. The plunger then is displaced to its fully open position where bypass flow is established. Because of the difference in effective area, the valve element will not reseat until the fuel system output pressure drops to a level that is a level below the pressure at which bypass flow begins. It has been found that an area ratio between the closed and open position, of at least ¼, has been found to be acceptable.

Figure 2:
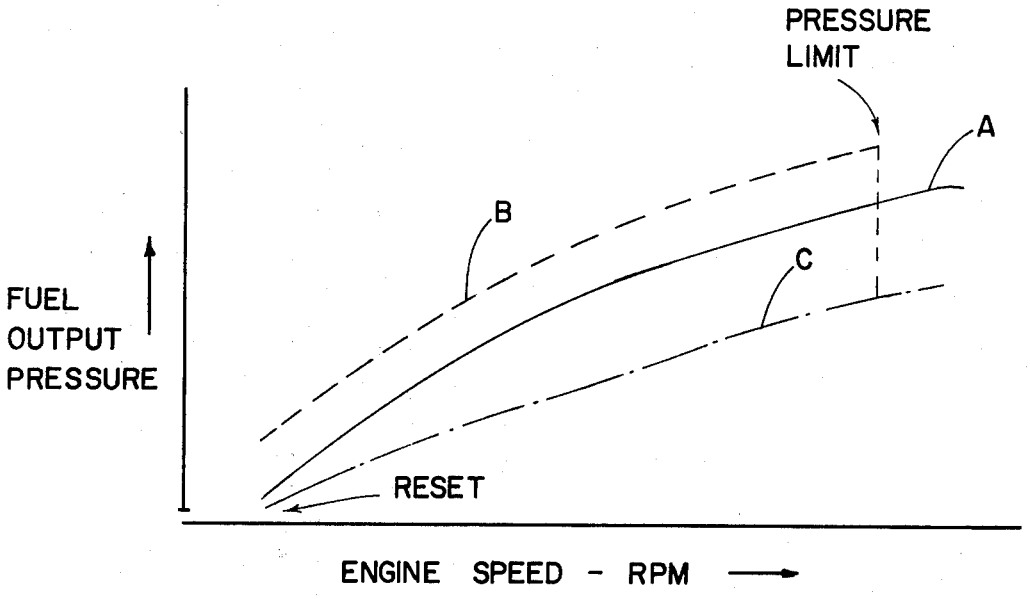
FIG. 2 is a graph of fuel pressure vs. engine RPM for the fuel system of FIG. 1; and, FIG. 3 is a graph of horspower output vs. engine RPM for the fuel system of FIG. 1.

During the period that bypass flow is established the quantity of flow is limited by orifices 58 and 60 to regulate pressure as shown in FIGS. 2. and 3. Curve A of FIG. 2. shows the normal scheduled wide open throttle fuel pressure of the fuel system as a function of engine RPM. It is seen that this fuel system pressure generally increases with increasing RPM up to a governor limit when the governor assembly 16 cuts back fuel to limit maximum RPM. Should a vehicle driver provide a restriction in the line, the pressure will follow Curve B. This curve generally conforms to Curve A but is at a higher level. With the restriction in the line, the fuel system pressure follows Curve B until it reaches the pressure limit where the valve element 62 is displaced to its open position. The pressure immediately falls to a schedule shown by Curve C which is at lower pressure levels than the schedule for Curve A. Curve C is one of increasing pressure with increasing engine RPM but has a lower pressure for a given RPM than Curve A except at the reset point when plunger 62 is reseated against port 50. With flow being bypassed, the fuel system pressure even at wide open throttle will go no higher than the pressure set by Curve C, although the engine RPM can increase beyond the RPM at the pressure limit. If the fuel system pressure drops to the reset pressure level by retarding the throttle, the pressure in chamber 52 is lowered to the second given level where plunger 62 reseats against port 50 to terminate bypass flow. The reset pressure is roughly ¼ of the pressure limit pressure as set by the area ratio previously defined. The closeness of Curve C to the normal Curve A is controlled by the area of orifices 58 and 60. In other words, the smaller their area, the closer the Curve C will be to the normal schedule A. It has been found that even without orifices 58 and 60, ports 54 will act as orifices and cause the pressure to follow a scheduled curve but at a much lower level.

Figure 3:
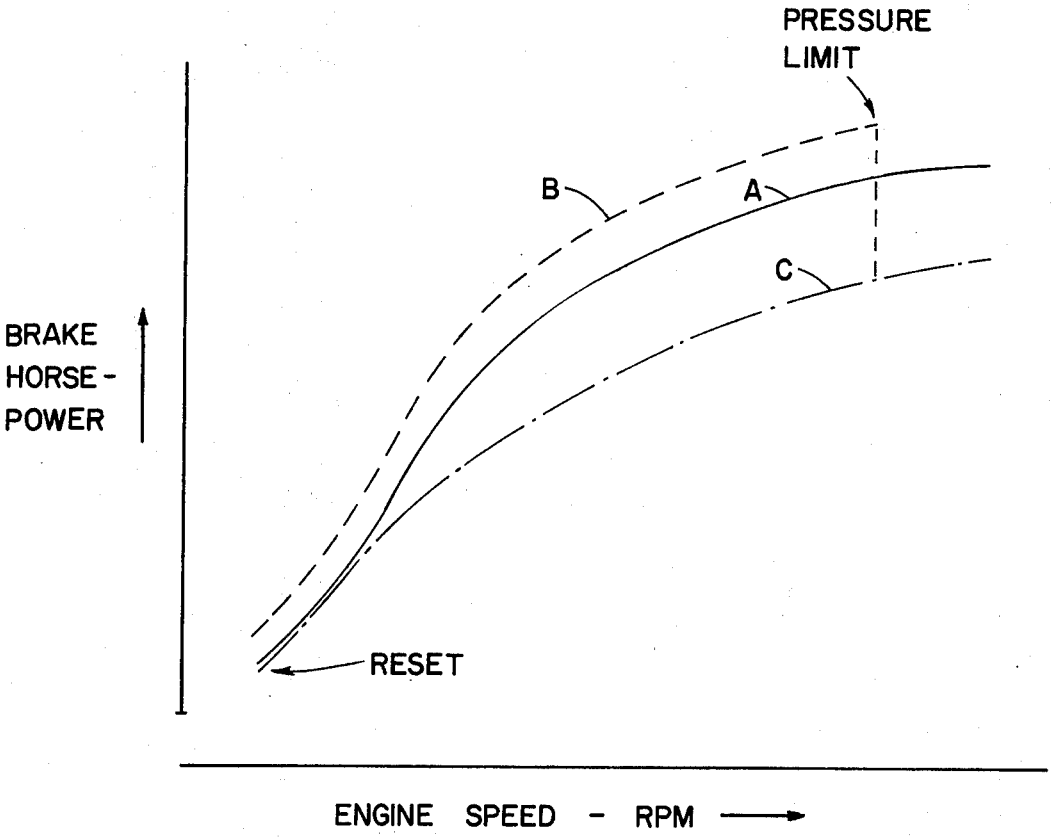

Translating the pressure curve into horsepower output, which a driver can feel, we can see Curve A on FIG. 3, which is normal wide open throttle horsepower vs. RPM. When a restriction is placed in the drain line the engine horsepower will follow Curve B due to the increased fuel system pressure. However, when the system pressure reaches the pressure limit point, the horsepower immediately drops to that of Curve C. Generally speaking, the control valve causes the driver to experience a reduction in horsepower sufficient to make him aware of the fact that the engine is malfunctioning but still with a power level high enough to permit safe operation of a vehicle. The net effect of the control valve is to force the driver to down shift into a lower gear than he would normally select due to the lower pressure of the system. When he backs off the throttle to shift down, the fuel system pressure goes to the reset point after which the valve follows Curve B up to the pressure limit. The valve will continue to bypass and terminate flow as long as the restriction is maintained in the drain line. When the restriction is removed the fuel system will function normally and the valve 40 will not bypass flow.

Valve 40 is extremely simplified and is placed entirely within the fuel system housing to prevent tampering. It is easily adjustable by virtue of the plug 70. A selection of orifice sizes for 58 and 60 enables the valve to be tailored to the particular characteristics of an engine.

While a preferred embodiment of the present invention has been described, it should be apparent that it may be employed in different forms without departing from its spirit and scope. Having thus described the invention, what is claimed novel and desired to be secured by letters patent of the U.S. is:

1. A pressure responsive control valve for a fuel system supplying fuel at a variable pressure to an internal combustion engine, said valve comprising:

a housing having a cylindrical chamber therein and an inlet extending from one end of said cylindrical chamber to the variable pressure output of said fuel system, said housing means having a bypass outlet connected to a low pressure section of said fuel system;

a cylindrical element having a conical elastomeric tip displaceable axially in said chamber from a first position in which the conical tip seats against said inlet to prevent flow through said chamber and a second position in which it permits flow therethrough, said valve element being urged toward said second position by the fuel pressure of said system, the area of said inlet being a given ratio less than the cross sectional area of said chamber taken in a plane at a right angle to the direction of travel of said valve element thereby permitting the area of the valve element exposed to fuel system pressure to vary from a first area when the valve element is in said first position to a second and substantially larger area when said valve is in said second position;

a spring acting on said valve element;

a plug threaded into the end of said housing and forming the end of said chamber opposite the inlet end, whereby said spring abuts said plug, said plug being rotatable to vary axial position of one end of said spring and thus vary the force it applies to said valve element, said plug having an elastomeric pad positioned in the threaded section thereof for restraining said plug in a selected position thereby varying the pressure at which fuel is bypassed;

means defining a predetermined orifice removably interposed in said bypass outlet for providing a predetermined restriction to flow, whereby when the pressure in said fuel system exceeds a given first level said valve bypasses flow to reduce the pressure thereof, said valve requiring the fuel system pressure to drop to a second level below said first level before bypass flow is terminated and the output pressure of said fuel system is varied through a range of pressures intermediate said first and second levels.

2. Apparatus as in claim 1. wherein said area ratio is at least as low as ¼.

3. Apparatus as in claim 1. further comprising means for varying the force with which said yieldably urging means pushes said valve element toward said first position.

4. Apparatus as in claim 1. wherein said housing means has at least one passage from the end of said chamber opposite said inlet end to said low pressure section of said fuel system.

5. In a fuel system for an internal combustion engine comprising:

a fuel pump for pressurizing fuel:

means connected to the output of said pump for varying the pressure thereof in response to operator demand and engine operating parameters in accordance with a first scheduled function of engine RPM, said schedule generally increasing with increasing RPM up to a given maximum pressure;

at least one fuel injector receiving the output of said pressure varying means, said injector being of the open flow type in which excess fuel not consumed by said engine is passed to low pressure through a drain line;

the improvement comprising:

a flow control valve connected to the output of said pressure varying means for selectively bypassing fuel to a low pressure section of said fuel system when the output pressure thereof exceeds a first given level above said maximum scheduled pressure of said fuel system and terminating bypass flow when the pressure output is reduced to a second and substantially lower given level, removable means defining an orifice with a predetermined flow area in the bypass flow path of said flow control valve whereby the fuel system output pressure is varied as a function of RPM in accordance with a second predetermined schedule, the fuel pressure of said second schedule being lower for a given RPM than said first schedule until the fuel pressure reaches said second given level.

6. Apparatus as in claim 5. wherein said flow control valve comprises:

means defining a housing having a chamber therein and an inlet extending to the output of said pressure varying means, said housing means having an outlet connected to a low pressure section of said fuel system;

a valve element displaceable in said chamber from a first position in which it abuts said inlet to prevent flow and a second position in which it permits flow therethrough, said valve element being urged toward said second position by the fuel pressure of said system;

means for yieldably urging said valve element towards said first position with a given force level;

the area of said inlet being less than the area of said chamber taken in a plane at a right angle to the direction of displacement of said valve element by a predetermined ratio.

7. Apparatus as in claim 6. wherein said ratio is at least ¼.

* * * * *